US010816919B2

(12) United States Patent
Hasebe

(10) Patent No.: US 10,816,919 B2
(45) Date of Patent: Oct. 27, 2020

(54) POWER SOURCE DEVICE, POWER SOURCE CONTROL METHOD, AND IMAGE FORMING APPARATUS

(71) Applicant: Taiki Hasebe, Kanagawa (JP)

(72) Inventor: Taiki Hasebe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/273,022

(22) Filed: Feb. 11, 2019

(65) Prior Publication Data

US 2019/0286019 A1 Sep. 19, 2019

(30) Foreign Application Priority Data

Mar. 16, 2018 (JP) ..... 2018-049434
Nov. 21, 2018 (JP) ..... 2018-218701

(51) Int. Cl.
*G03G 15/16* (2006.01)
*G03G 15/00* (2006.01)

(52) U.S. Cl.
CPC ..... *G03G 15/1675* (2013.01); *G03G 15/1605* (2013.01); *G03G 15/5004* (2013.01); *G03G 15/80* (2013.01); *G03G 2215/0122* (2013.01)

(58) Field of Classification Search
CPC ..... G03G 15/1675
See application file for complete search history.

(56) References Cited

U.S. PATENT DOCUMENTS 8,023,126 B2 * 9/2011 Semma ..... G03G 15/2039 324/500
9,465,348 B2 * 10/2016 Maekawa ..... G03G 15/80
2008/0155294 A1 6/2008 Kikuchi et al.
2012/0045237 A1 2/2012 Aoki et al.
2014/0265552 A1 9/2014 Maekawa et al.
2014/0328604 A1 11/2014 Tanaka et al.
2017/0329263 A1 * 11/2017 Sugiura ..... G03G 15/1665

FOREIGN PATENT DOCUMENTS

JP H11-038842 2/1999
JP 2008-176288 7/2008
JP 2012-042835 3/2012

(Continued)

*Primary Examiner* — Clayton E. LaBalle
*Assistant Examiner* — Leon W Rhodes, Jr.
(74) *Attorney, Agent, or Firm* — Duft & Bornsen, PC

(57) ABSTRACT

According to an embodiment, a power source device includes a direct current power source, an alternating current power source, a bypass capacitor, and a power source control unit. The direct current power source outputs a direct current voltage. The alternating current power source outputs a superimposed voltage having an alternating current voltage superimposed on the direct current voltage. The bypass capacitor partially accumulates a charge of alternating current for prevention of flow of current into the direct current power source from the alternating current power source. The power source control unit switches control of the direct current voltage from constant current control to constant voltage control and causes a charge of the alternating current to be accumulated in the bypass capacitor in a short time period between a transfer period and a non-transfer period both related to image formation.

9 Claims, 7 Drawing Sheets

(56) References Cited

FOREIGN PATENT DOCUMENTS

| | | | | |
|---|---|---|---|---|
| JP | 2014-180181 | | | 9/2014 |
| JP | 2015-156782 | | | 8/2015 |
| JP | 2015-194663 | | | 11/2015 |
| JP | 2017028980 | A | * | 2/2017 |
| JP | 2017-209952 | | | 11/2017 |

* cited by examiner

POWER SOURCE DEVICE, POWER SOURCE CONTROL METHOD, AND IMAGE FORMING APPARATUS

CROSS-REFERENCE TO RELATED APPLICATIONS

The present application claims priority under 35 U.S.C. § 119 to Japanese Patent Application No. 2018-049434, filed on Mar. 16, 2018 and Japanese Patent Application No. 2018-218701 filed in Japan on Nov. 21, 2018. The contents of which are incorporated herein by reference in their entirety.

BACKGROUND OF THE INVENTION

1. Field of the Invention

The present invention relates to a power source device, a power source control method, and an image forming apparatus.

2. Description of the Related Art

A technique for printing on sheets of paper having surface roughness has been demanded in the production print market recently. Only a power source is used when toner is transferred onto normal sheets of recording paper. However, since toner is difficult to be transferred onto depressions of sheets of paper having surface roughness as compared to projections thereof, when an image is formed on a sheet of recording paper high in surface roughness, toner may be not transferred onto the depressions, and defects, such as white spots and density unevenness, may be generated in the image. Known already for prevention of such defects is a technique where a direct current power source and an alternating current power source are connected in series, superimposed voltage (direct current+alternating current) having alternating current voltage superimposed on direct current voltage is applied to a transfer unit, and an image is transferred onto a sheet of recording paper.

Furthermore, increase in speed of copying machines has been demanded recently. For the number of pages printed per minute (ppm) to be increased, intervals between sheets of recording paper (paper sheet intervals) need to be shortened. When an image is transferred onto a sheet of recording paper, high voltage is needed. Therefore, when the paper sheet intervals are shortened, rise and fall times needed for output of voltage need to be reduced.

Disclosed in Japanese Unexamined Patent Application Publication No. 2015-194663 is a technique for reduction of the rise time of voltage. According to this publication, a transfer bias power source causes a direct current component of the transfer bias to rise by constant voltage control such that a preset target voltage is achieved, and thereafter switches over to constant current control such that a preset target current is achieved before a toner image on an image bearer is transferred onto a recording medium.

However, with a configuration where an alternating current power source is connected in series to a direct current power source, direct current voltage that is output from the alternating current power source flows into a bypass capacitor until a charge has been discharged from the bypass capacitor and a charge has been accumulated in the bypass capacitor. Therefore, as compared to a case where a direct current source is used alone, there is problem that time is required for direct current voltage output by the direct current power source to fall from a negative potential to a positive potential, and that the image quality is reduced and the toner is wastefully consumed in the paper sheet intervals.

In view of the above, there is a need to provide a power source device, a power source control method, and an image forming apparatus, which enable a rise time of direct current voltage to be shortened in a configuration where an alternating current power source is connected in series to a direct current power source.

SUMMARY OF THE INVENTION

According to an embodiment, a power source device includes a direct current power source, an alternating current power source, a bypass capacitor, and a power source control unit. The direct current power source outputs a direct current voltage. The alternating current power source outputs a superimposed voltage having an alternating current voltage superimposed on the direct current voltage. The bypass capacitor partially accumulates a charge of alternating current for prevention of flow of current into the direct current power source from the alternating current power source. The power source control unit switches control of the direct current voltage from constant current control to constant voltage control and causes a charge of the alternating current to be accumulated in the bypass capacitor in a short time period between a transfer period and a non-transfer period both related to image formation.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
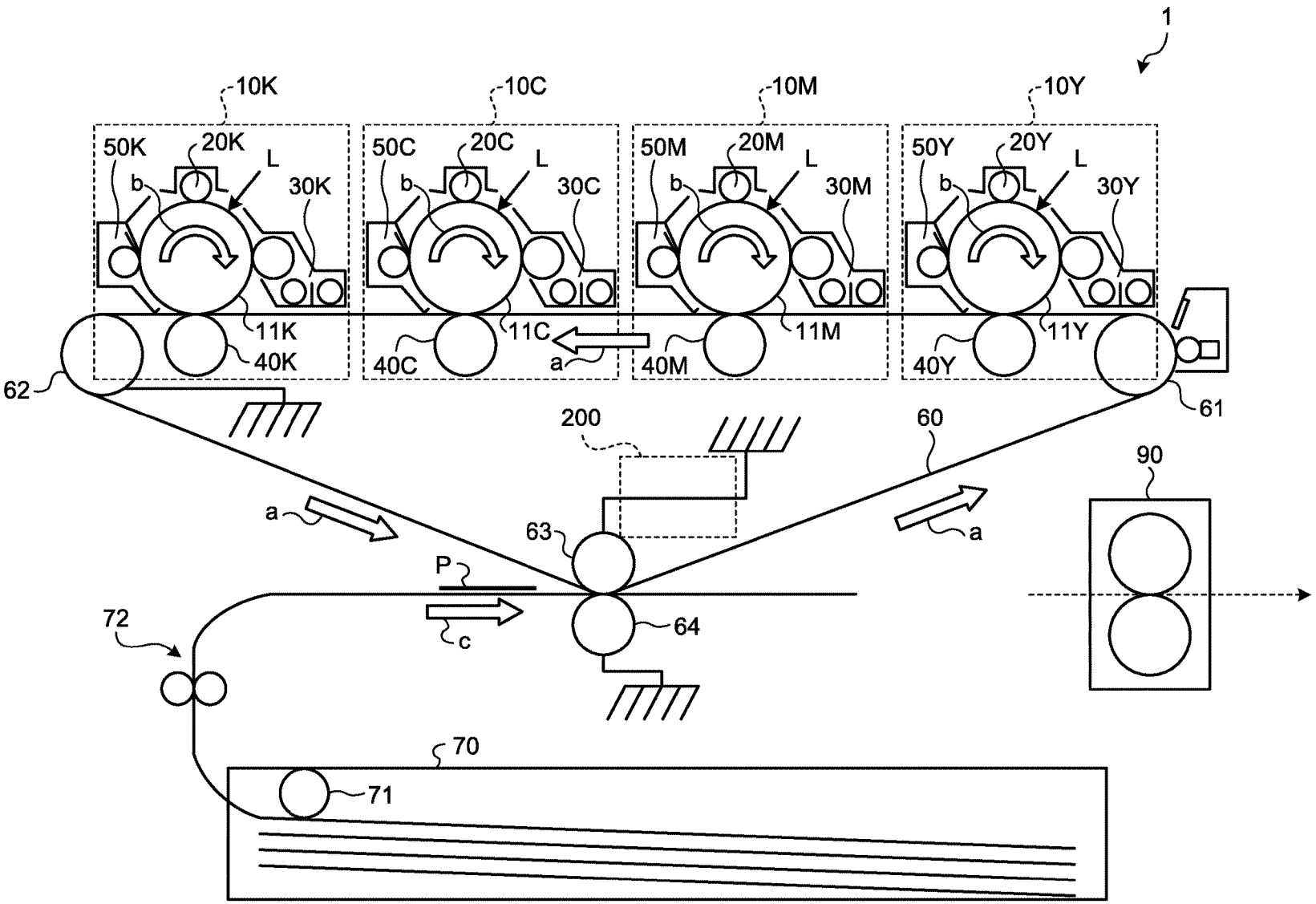
FIG. 1 is a diagram schematically illustrating an example of a hardware configuration of a printing apparatus according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Hereinafter, by reference to the appended drawings, an embodiment of a power source device, a power source control method, and an image forming apparatus will be described in detail. Described hereinafter as the embodiment is an example where a power source device and an image forming apparatus have been applied to an electrophotographic printing apparatus. The printing apparatus may be a color printing apparatus or a monochrome printing apparatus. Furthermore, the power source device and the image forming apparatus may also be applied to an electrophotographic copying machine, a multifunction peripheral (MFP), or the like, instead of the printing apparatus. The multifunctional peripheral is an apparatus having at least two of: a printer function, a copier function; a scanner function; and a facsimile function.

Figure 2:
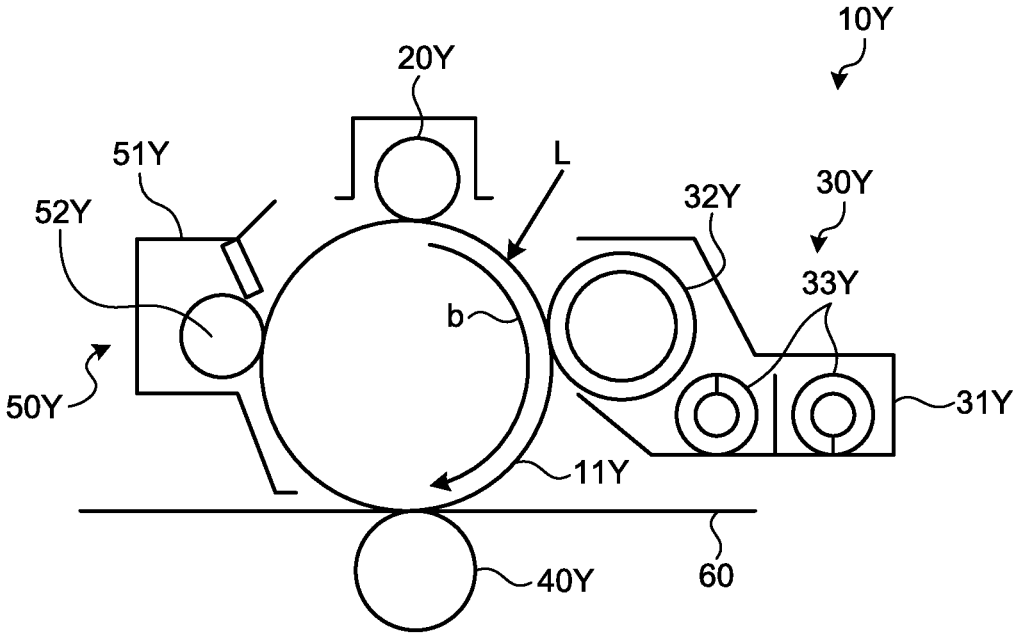
FIG. 2 is an explanatory diagram for an image forming unit included in the printing apparatus.

FIG. 1 is a diagram schematically illustrating an example of a hardware configuration of a printing apparatus 1 according to the embodiment. FIG. 2 is an explanatory diagram for an image forming unit included in the printing apparatus 1.

As illustrated in FIG. 1, the printing apparatus 1 includes: image forming units 10Y, 10M, 10C, and 10K; an intermediate transfer belt 60; support rollers 61 and 62; a secondary transfer counter roller (repulsive roller) 63; a secondary transfer roller 64; a sheet cassette 70; a sheet feeding roller 71; a conveying roller pair 72; a fixing device 90; and a secondary transfer power source 200.

The image forming units 10Y, 10M, 10C, and 10K are arranged along the intermediate transfer belt 60 from an upstream side of the intermediate transfer belt 60 along a movement direction (an arrow-a direction) thereof in the order of the image forming units 10Y, 10M, 10C, and 10K. The image forming units 10Y, 10M, 10C, and 10K respectively form yellow, magenta, cyan, and black toner images (color component images) by image formation processes, and transfer the respective toner images onto the intermediate transfer belt 60.

The image forming units 10Y, 10M, 10C, and 10K include components common to one another. The components of the image forming units 10Y, 10M, 10C, and 10K, and steps performed by the above mentioned image formation processes, which are, in the order of a charging step, an irradiation step, a developing step, and a transfer step, will be described by explanation of the image forming unit 10Y as an example. Since explanation for the other image forming units 10M, 10C, and 10K will be similar to that of the image forming unit 10Y, the other image forming units 10M, 10C, and 10K are illustrated by substitution of the symbol Y assigned to the components of the image forming unit 10Y with the symbols M, C, and K respectively, and description of these image forming units 10M, 10C, and 10K will be omitted.

As illustrated in FIG. 2, the image forming unit 10Y includes a photoconductor drum 11Y, a charging device 20Y, a developing device 30Y, a primary transfer roller 40Y, and a cleaning device 50Y.

The photoconductor drum 11Y is an image bearer, and is rotationally driven in a b-arrow direction. The photoconductor drum 11Y is, for example, an organic photoconductor having an outer diameter of 60 mm. When a color image is formed, the photoconductor drums 11Y, 11M, 11C, and 11K for the respective colors are rotationally driven in synchronization with one another, but when a monochrome image is formed, the photoconductor drum 11K for black is rotationally driven independently of the other photoconductor drums 11Y, 11M, and 11C.

The developing device 30Y includes a container 31Y, a developing sleeve 32Y accommodated in the container 31Y, and screw members 33Y accommodated in the container 31Y. The container 31Y has a two-component developer accommodated therein, the two-component developer having a yellow toner and a carrier. The developing sleeve 32Y is a developer bearer, and is arranged to face the photoconductor drum 11Y via an opening of the container 31Y. The screw members 33Y are stirring members that convey the developer while stirring the developer. The screw members 33Y are arranged at a developer supplying side that is at a developer sleeve side, and at a receiving side where supply is received from a toner supplying device, and are rotatably supported in the container 31Y by bearing members not illustrated in the drawings.

The primary transfer roller 40Y is an elastic roller having, for example, a conductive sponge layer, and is arranged to be pressed against the photoconductor drum 11Y from the underside of the intermediate transfer belt 60. The elastic roller has a bias applied thereto, the bias serving as a primary transfer bias and having been subjected to constant current control. The primary transfer roller 40Y has, for example, an outer diameter of 16 mm; a diameter of a metal core thereof is 10 mm; and the resistance R of the sponge layer is approximately 3E7Ω. The value of the resistance R of the sponge layer is a value calculated by use of Ohm's Law (R=V/I), from the current I flowing when a voltage V of 1000 V is applied to the metal core of the primary transfer roller 40Y in a state where a metal roller being grounded and having an outer diameter of 30 mm has been pressed against the sponge layer at 10 N.

In the charging step, the charging device 20Y charges a surface of the photoconductor drum 11Y that is being rotationally driven, to a predetermined polarity (for example, a minus polarity).

In the irradiation step, an irradiation device irradiates the charged surface of the photoconductor drum 11Y with optically modulated laser light L, and forms an electrostatic latent image on the surface of the photoconductor drum 11Y. As a result, a portion of the surface of the photoconductor drum 11Y, the portion having been irradiated with the laser light L and reduced in the absolute value of its potential, becomes the electrostatic latent image (image portion), and a portion of the surface becomes a background portion, the portion not having been irradiated with the laser light L and having the absolute value of its potential maintained high.

In the developing step, the developing device 30Y develops the electrostatic latent image formed on the photoconductor drum 11Y with the yellow toner, and forms a yellow toner image on the photoconductor drum 11Y.

In the transfer step, the primary transfer roller 40Y transfers the yellow toner image formed on the photoconductor drum 11Y, onto the intermediate transfer belt 60. The photoconductor drum 11Y has a small amount of untransferred toner remaining thereon even after the transfer of the toner image.

In the cleaning step, the cleaning device 50Y wipes off the untransferred toner remaining on the photoconductor drum 11Y. The cleaning device 50Y includes a cleaning blade 51Y and a cleaning brush 52Y. The cleaning blade 51Y cleans the surface of the photoconductor drum 11Y in a state of being in contact with the photoconductor drum 11Y from a counter direction with respect to a rotation direction of the photoconductor drum 11Y. The cleaning brush 52Y cleans the surface of the photoconductor drum 11Y in a state of being in contact with the photoconductor drum 11Y while rotating in a direction opposite to the rotation direction of the photoconductor drum 11Y.

By reference back to FIG. 1, description of the remaining portions will be continued. The intermediate transfer belt 60 is an endless belt that is put around plural rollers, such as the support rollers 61 and 62 and the secondary transfer counter roller 63, and endlessly moves in the arrow-a direction, by one of the support rollers 61 and 62 being rotationally driven.

Onto the intermediate transfer belt 60, the yellow toner image is firstly transferred by the image forming unit 10Y, and subsequently, a magenta toner image by the image forming unit 10M, a cyan toner image by the image forming unit 10C, and a black toner image by the image forming unit 10K are sequentially transferred by being superimposed on one another. Thereby, a full color toner image (a full color image) is formed on the intermediate transfer belt 60. The intermediate transfer belt 60 then conveys the full color toner image formed, to a nip between the secondary transfer counter roller 63 and the secondary transfer roller 64.

The intermediate transfer belt 60 is formed of an endlessly formed carbon-dispersed polyimide resin having, for example: a thickness of 20 μm to 200 μm, preferably approximately 60 μm; a volume resistivity of 6.0 Log Ωcm to 13.0 Log Ωcm, preferably 7.5 Log Ωcm to 12.5 Log Ωcm, more preferably approximately 9 Log Ωcm; and a surface resistivity of 9.0 Log Ωcm to 13.0 Log Ωcm, preferably 10.0 Log Ωcm to 12.0 Log Ωcm. The volume resistivity is a value of resistance measured with Hiresta and an HRS probe both manufactured by Mitsubishi Chemical Analytec Co., Ltd, at 100 V, for 10 sec; and the surface resistivity is a value of resistance measured with Hiresta and an HRS probe both manufactured by Mitsubishi Chemical Analytec Co., Ltd, at 500 V, for 10 sec. The support roller 62 is grounded.

The sheet cassette 70 has, accommodated in each tray thereof, plural sheets of recording paper overlapping one another. The type and size of the sheets of recording paper may vary from tray to tray where the sheets of recording paper are accommodated. According to this embodiment, the recording paper is, for example, ordinary paper and leather-textured paper high in surface roughness, but the recording paper is not limited to these examples.

The sheet feeding roller 71 is in contact with a sheet of recording paper P positioned uppermost in each tray of the sheet cassette 70, and feeds the sheet of recording paper P in contact with the sheet feeding roller 71.

The conveying roller pair 72 conveys the sheet of recording paper P fed by the sheet feeding roller 71, to the nip between the secondary transfer counter roller 63 and the secondary transfer roller 64 (in an arrow-c direction) at a predetermined timing.

At the secondary transfer nip between the secondary transfer counter roller 63 and the secondary transfer roller 64, the secondary transfer counter roller 63 and the secondary transfer roller 64 transfer the full color toner image conveyed by the intermediate transfer belt 60 at once onto the sheet of recording paper P conveyed by the conveying roller pair 72.

The secondary transfer counter roller 63 has, for example, an outer diameter of 24 mm; a diameter of a metal core thereof is 16 mm; and the secondary transfer counter roller 63 has a conductive NBR rubber layer(or SUS). The resistance R of the conductive NBR rubber layer is 6.0 Log Ω to 12.0 Log Ω, preferably 4.0 Log Ω. The secondary transfer roller 64 has, for example, an outer diameter of 24 mm; a diameter of a metal core thereof is 14 mm; and the secondary transfer roller 64 has a conductive NBR rubber layer. The resistance R of the conductive NBR rubber layer is 6.0 Log Ω to 8.0 Log Ω, preferably 7.0 Log Ω to 8.0 Log Ω. The volume resistance of the secondary transfer roller 64 is a value of resistance measured by rotation measurement, and is obtained as an average value of resistances each measured when a weight of 5 N is applied to one side, a bias of 1 kV is applied to a transfer roller shaft, and the roller is rotated once in a one-minute measurement.

The secondary transfer power source 200 for a transfer bias is connected to the secondary transfer counter roller 63. The secondary transfer power source 200 applies a voltage to the secondary transfer counter roller 63 so as to transfer the full color toner image onto the sheet of recording paper P at the secondary transfer nip. Specifically, according to a user setting, the secondary transfer power source 200 applies only a direct current voltage (which may be, hereinafter, referred to as the "DC bias") to the secondary transfer counter roller 63, or applies a superimposed voltage (which may, hereinafter, be referred to as the "superimposed bias") having a direct current voltage and an alternating current voltage superimposed on each other, to the secondary transfer counter roller 63. Thereby, a potential difference is generated between the secondary transfer counter roller 63 and the secondary transfer roller 64, a voltage that causes the toner to go toward the sheet of recording paper P from the intermediate transfer belt 60 is generated, and thus the full color toner image is able to be transferred onto the sheet of recording paper P. The potential difference according to this embodiment is "the potential at the secondary transfer counter roller 63"—"the potential at the secondary transfer roller 64".

The fixing device 90 applies heat and pressure to the sheet of recording paper P where the full color toner image has been transferred, thereby fixing the full color toner image onto the sheet of recording paper P. The sheet of recording paper P having the full color toner image fixed thereon is ejected outside the printing apparatus 1.

Figure 3:
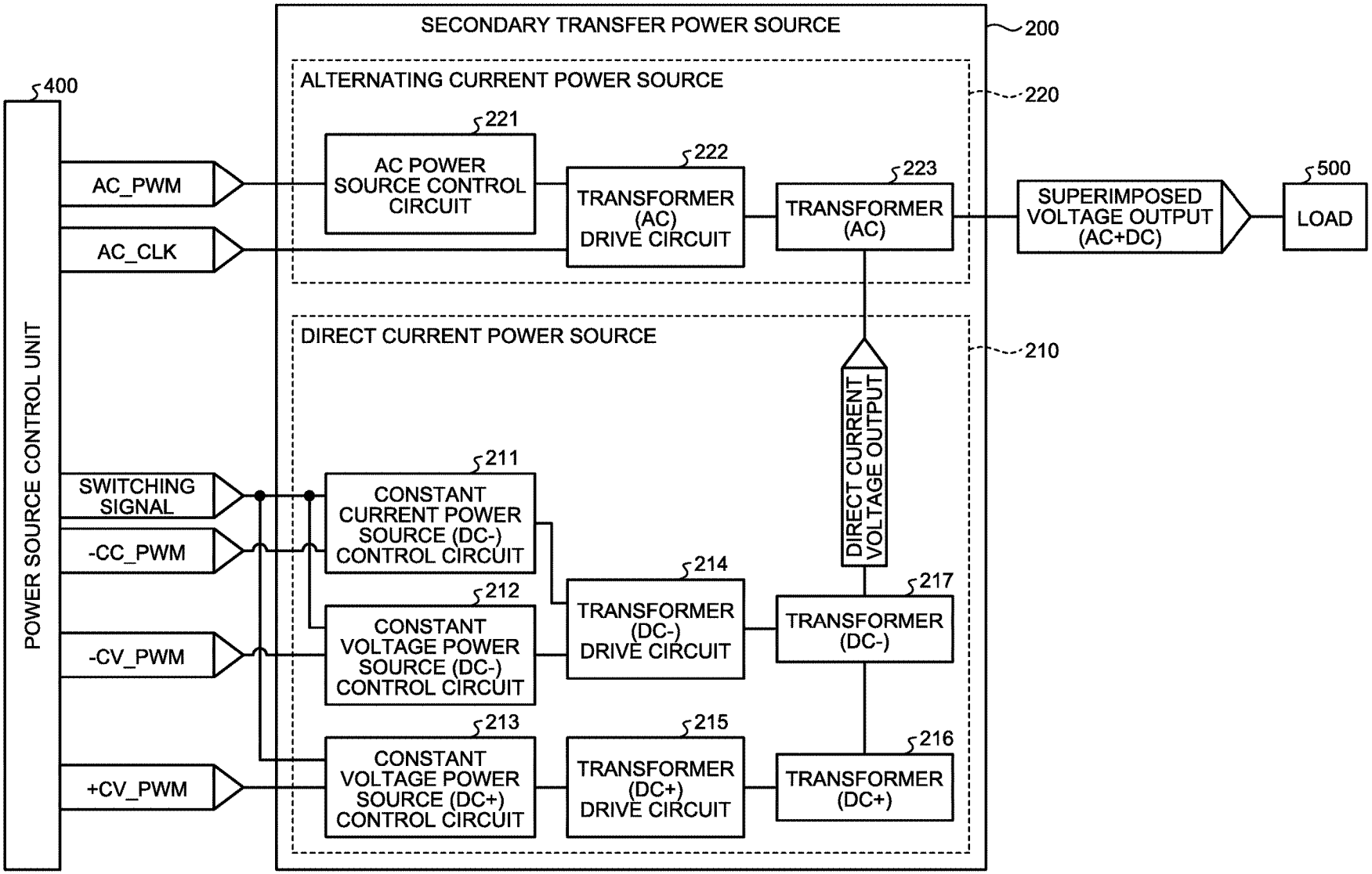
FIG. 3 is a diagram illustrating an example of a configuration of functional blocks of a secondary transfer power source.

FIG. 3 is a diagram illustrating an example of a configuration of functional blocks of the secondary transfer power source 200. As illustrated in FIG. 3, the secondary transfer power source 200 includes a direct current power source 210 and an alternating current power source 220. The direct current power source 210 functions as a power source for toner transfer, and the alternating current power source 240 functions as a power source for toner vibration. The direct current power source 210 and the alternating current power source 220 operate based on control signals from a power source control unit 400 (for example, a CPU), and apply drive voltage to a load 500 of the secondary transfer power source 200. The load 500 of the secondary transfer power source 200 corresponds to the secondary transfer roller 64, the secondary transfer counter roller 63, and the like; and the application of the drive voltage to the load 500 changes the field intensity between the secondary transfer roller 64 and secondary transfer counter roller 63 and the directions thereof.

The direct current power source 210 has a constant current power source (DC−) control circuit 211, a constant voltage power source (DC−) control circuit 212, a constant voltage power source (DC+) control circuit 213, a transformer (DC−) drive circuit 214, a transformer (DC+) drive circuit 215, a direct current voltage transformer (DC+) 216, and a direct current voltage transformer (DC−) 217.

The alternating current power source 220 is a power source for toner vibration, and has an AC power source control circuit 221, a transformer (AC) drive circuit 222, and an alternating current voltage transformer (AC) 223.

Figure 4:
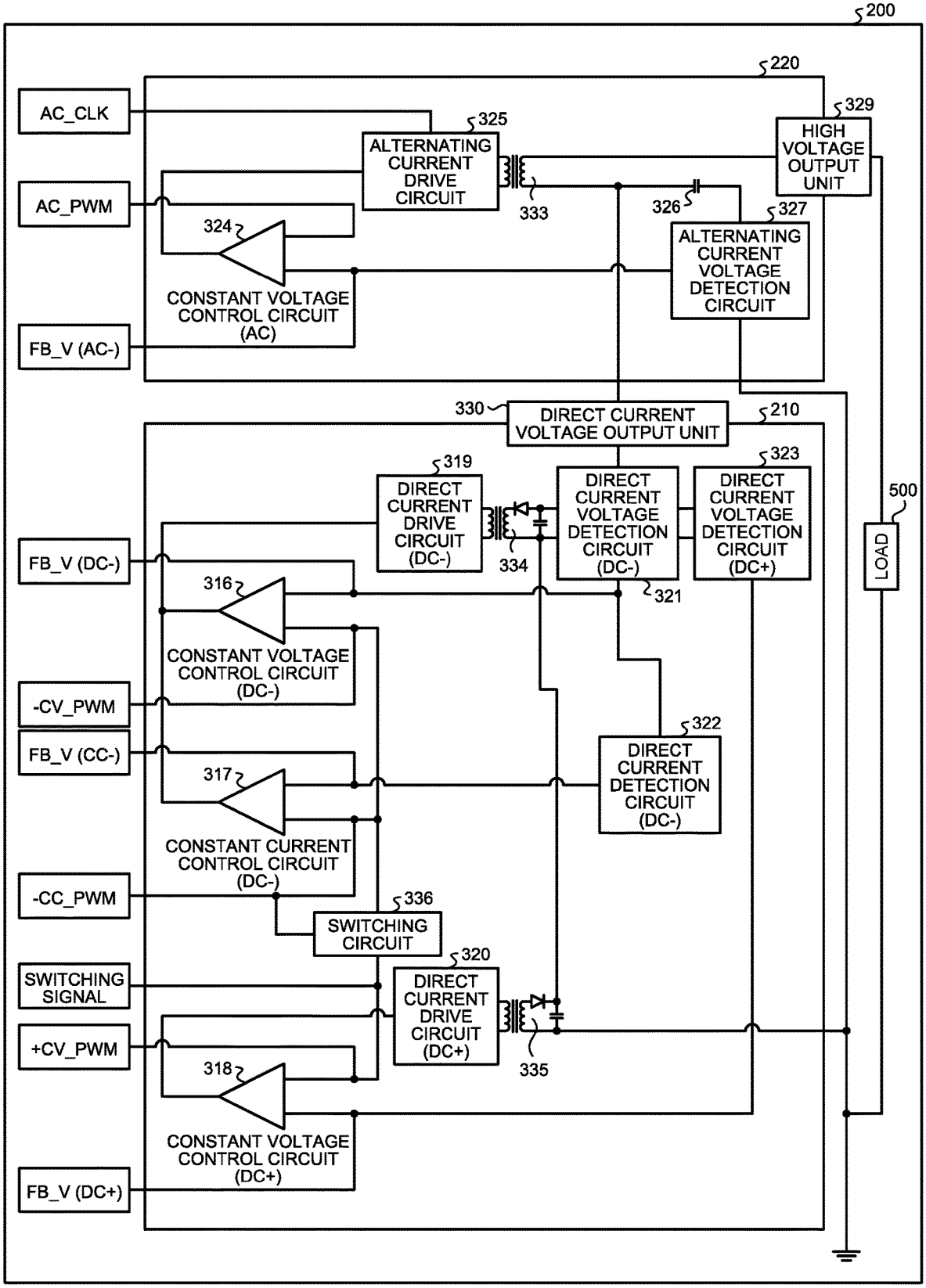
FIG. 4 is a diagram illustrating an example of a circuit configuration of the secondary transfer power source.

FIG. 4 is a diagram illustrating an example of a circuit configuration of the secondary transfer power source 200. As illustrated in FIG. 4, the direct current power source 210 includes a constant voltage control circuit (DC−) 316, a constant current control circuit (DC−) 317, a constant voltage control circuit (DC+) 318, a direct current drive circuit (DC−) 319, a direct current drive circuit (DC+) 320, a direct current voltage detection circuit (DC−) 321, a direct current voltage detection circuit (DC+) 323, a direct current detection circuit (DC−) 322, a direct current voltage output unit 330, a switching circuit 336, a transformer (DC−) 334, and a transformer (DC+) 335.

The direct current power source 210 receives, from the power source control unit 400, a −CV_PWM signal, a −CC_PWM signal, a +CV_PWM signal, and a switching signal. The −CV_PWM signal is connected to the constant voltage control circuit (DC−) 316, the −CC_PWM signal to the constant current control circuit (DC−) 317 and the switching circuit 336, and the +CV_PWM signal to the constant voltage control circuit (DC+) 318.

The switching signal is input to the switching circuit 336, and thereafter connected to each of the control circuits. Control signals output from the constant voltage control circuit (DC−) 316 and the constant current control circuit (DC−) 317 are input to the direct current drive circuit (DC−) 319, and drive the transformer (DC−) 334; and a direct current voltage (DC−) is applied to the direct current voltage output unit 330. A control signal output from the constant voltage control circuit (DC+) 318 is input to the direct current drive circuit (DC+) 320, and drives the transformer (DC+) 335; and a direct current voltage (DC+) is applied to the direct current voltage output unit 330. Hereinafter, description will be made in detail.

The switching circuit 336 is a switch for switching over control of direct current voltage to one of the constant voltage control circuit (DC−) 316, the constant current control circuit (DC−) 317, and the constant voltage control circuit (DC+) 318. For example, the switching circuit 336 performs the switchover by turning input of a reference voltage on or off.

The constant voltage control circuit (DC−) 316, the constant current control circuit (DC−) 317, and the constant voltage control circuit (DC+) 318 are each formed of a comparator.

The constant voltage control circuit (DC−) 316 receives a value obtained by calculation of the integral of the control signal (−CV_PWM signal) from the power source control unit 400, the value serving as a reference voltage value, and receives a voltage value of voltage taken out via the direct current drive circuit (DC−) 319 and the transformer (DC−) 334 according to the output level of the constant voltage control circuit (DC−) 316, the voltage value serving as a voltage value for comparison. The constant voltage control circuit (DC−) 316 controls the output signal such that the voltage value for comparison approaches the reference voltage value.

The constant current control circuit (DC−) 317 receives a value obtained by calculation of the integral of the control signal (−CC_PWM signal) from the power source control unit 400, the value serving as a reference current value, and receives a current value of current taken out via the direct current drive circuit (DC−) 319 and the transformer (DC−) 334 according to the output level of the constant current control circuit (DC−) 317, the current value serving as a current value for comparison. The constant current control circuit (DC−) 317 controls the output signal such that the current value for comparison approaches the reference current value.

The constant voltage control circuit (DC+) 318 receives a value obtained by calculation of the integral of the control signal (+CV_PWM signal) from the power source control unit 400, the value serving as a reference voltage value, and receives a voltage value of voltage taken out via the direct current drive circuit (DC+) 320 and the transformer (DC+) 335 according to the output level of the constant voltage control circuit (DC+) 318, the voltage value serving as a voltage value for comparison. The constant voltage control circuit (DC+) 318 controls the output signal such that the voltage value for comparison approaches the reference voltage value.

The direct current drive circuit (DC−) 319 is driven based on an input signal.

The transformer (DC−) 334 has a primary winding (N1_DC−) and a secondary winding (N2_DC−), and has a diode and a capacitor in the secondary winding (N2_DC−). Current generated in the secondary winding (N2_DC−) by electromagnetic induction from the primary winding (N1_DC−) by driving of the direct current drive circuit (DC−) 319 is smoothed by the diode and the capacitor.

The direct current voltage detection circuit (DC−) 321 outputs the value of voltage generated in the secondary winding (N2_DC−), to the constant voltage control circuit (DC−) 316.

The direct current detection circuit (DC−) 322 outputs the value of current generated in the secondary winding (N2_DC−), to the constant current control circuit (DC−) 317.

The direct current drive circuit (DC+) 320 is driven based on an input signal.

The transformer (DC+) 335 has a primary winding (N1_DC+) and a secondary winding (N2_DC+), and has a diode and a capacitor in the secondary winding (N2_DC+). Current generated in the secondary winding (N2_DC+) by electromagnetic induction from the primary winding (N1_DC+) by driving of the direct current drive circuit (DC+) 320 is smoothed by the diode and the capacitor.

The direct current voltage detection circuit (DC+) 323 outputs the value of voltage generated in the secondary winding (N2_DC+), to the constant voltage control circuit (DC+) 318.

The voltage generated in the secondary winding (N2_DC−) and the voltage generated in the secondary winding (N2_DC+) are output as direct current voltage to the alternating current power source 220 through the direct current voltage output unit 330.

The alternating current power source 220 has an alternating current drive circuit 325, a constant voltage control circuit (AC) 324, an alternating current voltage detection circuit 327, a transformer 333, a high voltage output unit 329, and an alternating current bypass capacitor 326, which is a bypass capacitor.

The alternating current power source 220 receives an AC_PWM signal and an AC_CLK signal, from the power source control unit 400. The AC_PWM signal is connected to the constant voltage control circuit (AC) 324. The AC_CLK signal, and a control signal that is output from the constant voltage control circuit (AC) 324 are input to the alternating current drive circuit 325, and drive the transformer (AC) 333; and an alternating current voltage is output by the transformer (AC) 333. The output alternating current voltage is superimposed with the direct current voltage from the direct current power source 210, and the superimposed voltage is applied to the high voltage output unit 329. The high voltage output by the high voltage output unit 329 is applied to the load 500. Hereinafter, description will be made in detail.

The constant voltage control circuit (AC) 324 receives a value obtained by calculation of the integral of the control signal (AC_PWM signal) from the power source control unit 400, the value serving as a reference voltage value, and receives a voltage value of the alternating current voltage taken out via the alternating current drive circuit 325 and the transformer 333 according to the output level of the constant voltage control circuit (AC) 324, the voltage value serving as a voltage value for comparison. The constant voltage control circuit (AC) 324 controls the output signal such that the voltage value for comparison approaches the reference voltage value.

The alternating current drive circuit 325 is driven based on an input signal and the clock signal (AC_CLK signal).

The transformer (AC) 333 has a primary winding (N1_AC) and a secondary winding (N2_AC), and has an alternating current bypass capacitor 326 in the secondary winding (N2_AC). Voltage generated in the secondary winding (N2_AC) by electromagnetic induction from the primary winding (N1_AC) by driving of the alternating current drive circuit 325 is superimposed on the direct current voltage output to the alternating current power source 220 through the direct current voltage output unit 330, and the superimposed voltage is applied to the load 500 through the high voltage output unit 329.

The alternating current voltage detection circuit 327 outputs a voltage value of the alternating current voltage generated in the secondary winding (N2_AC), to the constant voltage control circuit (AC) 324, the voltage value serving as a voltage value for comparison.

An FB_V(AC−) signal, an FB_V(DC−) signal, an FB_V (CC−) signal, and an FB_V(DC+) signal illustrated in FIG. 4 represent signals that the power source control unit 400 read from the direct current power source 210 and the alternating current power source 220.

Described next are circuits and signals for output by constant voltage control (DC−).

The integral of the −CV_PWM signal output from the power source control unit 400 is calculated, and is input to the constant voltage control circuit (DC−) 316. The value of the integral of the −CV_PWM signal serves as the reference voltage in the constant voltage control circuit (DC−) 316. Furthermore, the direct current voltage detection circuit (DC−) 321 detects the direct current voltage (DC−) output by the direct current power source 210, and inputs the detected output value of direct current voltage, to the constant voltage control circuit (DC−) 316.

The constant voltage control circuit (DC−) 316 then actively drives the direct current drive circuit (DC−) 319 of the direct current high voltage transformer when the detected output value of direct current voltage is smaller than the reference voltage, and restricts driving of the direct current drive circuit (DC−) 319 of the direct current high voltage transformer when the output value of the direct current voltage has reached the reference voltage (upper limit). Thereby, the direct current power source 210 maintains the voltage (DC−) constant. When the duty of the −CV_PWM signal is low, the time for the calculation of the integral is increased, and when the duty is high, the time for the calculation of the integral is decreased; and thus time corresponding to the duty is taken until a high voltage is output. Furthermore, the direct current voltage detection circuit (DC−) 321 feeds back, as the FB_V(DC−) signal, the detected output value of direct current voltage, to the power source control unit 400.

Described next are circuits and signals for output by constant current control (DC−).

The integral of the −CC_PWM signal output from the power source control unit 400 is calculated, and is input to the constant current control circuit (DC−) 317. The value of the integral of the −CC_PWM signal serves as the reference current in the constant current control circuit (DC−) 317. Furthermore, the direct current detection circuit (DC−) 322 detects the direct current (DC−) output by the direct current power source 210, and inputs the detected output value of direct current, to the constant current control circuit (DC−) 317. The constant current control circuit (DC−) 317 then actively drives the direct current drive circuit (DC−) 319 of the direct current high voltage transformer when the detected output value of direct current is smaller than the reference current, and restricts driving of the direct current drive circuit (DC−) 319 of the direct current high voltage transformer when the output value of direct current has reached the reference current (upper limit). Thereby, the direct current power source 210 maintains the current (DC−) constant. When the duty of the −CC_PWM signal is low, the time for the calculation of the integral is increased, and when the duty is high, the time for the calculation of the integral is decreased, and thus time corresponding to the duty is taken until the output is performed. Furthermore, the direct current detection circuit (DC−) 322 feeds back, as an FB_I (DC−) signal, the detected output value of direct current, to the power source control unit 400.

Described next are circuits and signals for output by constant voltage control (DC+).

The integral of the +CV_PWM signal output from the power source control unit 400 is calculated, and is input to the constant voltage control circuit (DC+) 318. The value of the integral of the +CV_PWM signal serves as the reference voltage in the constant voltage control circuit (DC+) 318. Furthermore, the direct current voltage detection circuit (DC+) 323 detects the direct current voltage (DC+) output by the direct current power source 210, and inputs the detected output value of direct current voltage, to the constant voltage control circuit (DC+) 318. The constant voltage control circuit (DC+) 318 then actively drives the direct current drive circuit (DC+) 320 of the direct current high voltage transformer when the detected output value of direct current voltage is smaller than the reference voltage, and restricts driving of the direct current drive circuit (DC+) 320 of the direct current high voltage transformer when the output value of direct current voltage has reached the reference voltage (upper limit). Thereby, the direct current power source 210 maintains the voltage (DC+) constant. When the duty of the +CV_PWM signal is low, the time for the calculation of the integral is increased, and when the duty is high, the time for the calculation of the integral is decreased, and thus time corresponding to the duty is taken until a high voltage is output. Moreover, the direct current voltage detection circuit (DC+) 323 feeds back, as the FB_V(DC+) signal, the detected output value of direct current voltage, to the power source control unit 400.

Driving of the transformer (DC−) 334 described below is in, for example, a case where the direct current drive circuit (DC−) 319 drives the transformer (DC−) 334.

By driving of the direct current drive circuit (DC−) 319 according to the control by the constant current control circuit (DC−) 317 and the constant voltage control circuit (DC−) 316, the output generated in the primary winding (N1_DC−) of the direct current high voltage transformer and the secondary winding (N2_DC−) of the direct current high voltage transformer is applied to the direct current voltage output unit 330 after being smoothed by the diode and capacitor, the output serving as a direct current voltage.

Described next is the output of alternating current voltage and the transformer (AC).

The alternating current power source 220 receives the AC_PWM signal and the AC_CLK signal, from the power source control unit 400. The AC_PWM signal is input to the constant voltage control circuit (AC) 324. The value of the input AC_PWM signal serves as a reference voltage in the constant voltage control circuit (AC) 324. The alternating current voltage detection circuit 327 detects an alternating current voltage on a low voltage side of the alternating current bypass capacitor 326 that is an output line of the secondary transfer power source 200, and inputs the detected output value of alternating current voltage, to the constant voltage control circuit (AC) 324. The constant voltage control circuit (AC) 324 actively drives the alternating current drive circuit 325 of the alternating current high voltage transformer when the alternating current voltage is smaller than the reference voltage, and restricts driving of the alternating current drive circuit 325 of the alternating current high voltage transformer when the alternating current voltage is larger than the reference voltage. Thereby, the alternating current power source 220 maintains the voltage (AC) constant. The AC_CLK signal is input to the alternating current drive circuit 325. The AC_CLK signal determines the frequency and form (sine wave, rectangular wave, or the like) of the AC. Furthermore, the alternating current voltage detection circuit 327 feeds back, as the FB_V(AC−) signal, the detected output value of alternating current voltage, to the power source control unit 400.

However, if the alternating current power source 220 has not been driven, the direct current voltage that is being applied to the secondary winding (N2_AC) is output (applied) to the load 500 from the high voltage output unit 329 as is.

Described now are characteristics of the alternating current bypass capacitor 326 in the secondary transfer power source 200.

The alternating current bypass capacitor 326 partially accumulates therein a charge of the alternating current for the alternating current output from the alternating current power source 220 to be prevented from reaching the direct current power source 210. The alternating current bypass capacitor 326 has a very high impedance for output of direct current, and thus enables the alternating current power source 220 to superimpose the direct current output at a low loss.

At the time of starting and ending secondary transfer, in order to invert the polarity of the direct current output to the load 500, the power source control unit 400 switches over the potential at the direct current voltage output unit 330 to the opposite polarity by control of the secondary transfer power source 200.

However, when this switchover is performed, a charge has been accumulated in the alternating current bypass capacitor 326, and until this charge in the alternating current bypass capacitor 326 has been discharged, sufficient electric power is unable to be supplied to the load 500. Therefore, it takes time for a fall until the direct current output is stabilized. A "fall" refers to a change from a state where there is a potential difference to a state where there is no potential difference, or to a state where the polarity of the potential difference has changed.

This is because, as described already, the DC bias output from the direct current power source 210 flows into the alternating current bypass capacitor 326 until the minus potential of the charge in the alternating current bypass capacitor 326 has been discharged and thereafter a plus potential has been accumulated. The upper limit of the amount of charge output as the DC bias is determined by the current value, and thus time is needed for a charge to be discharged and accumulated in the alternating current bypass capacitor 526.

According to the embodiment, the power source control unit 400 temporarily performs constant voltage control of the secondary transfer power source 200 at the start and end of secondary transfer, thereby shortening the rise time for the direct current output at each of the start and end of the secondary transfer.

Figure 5:
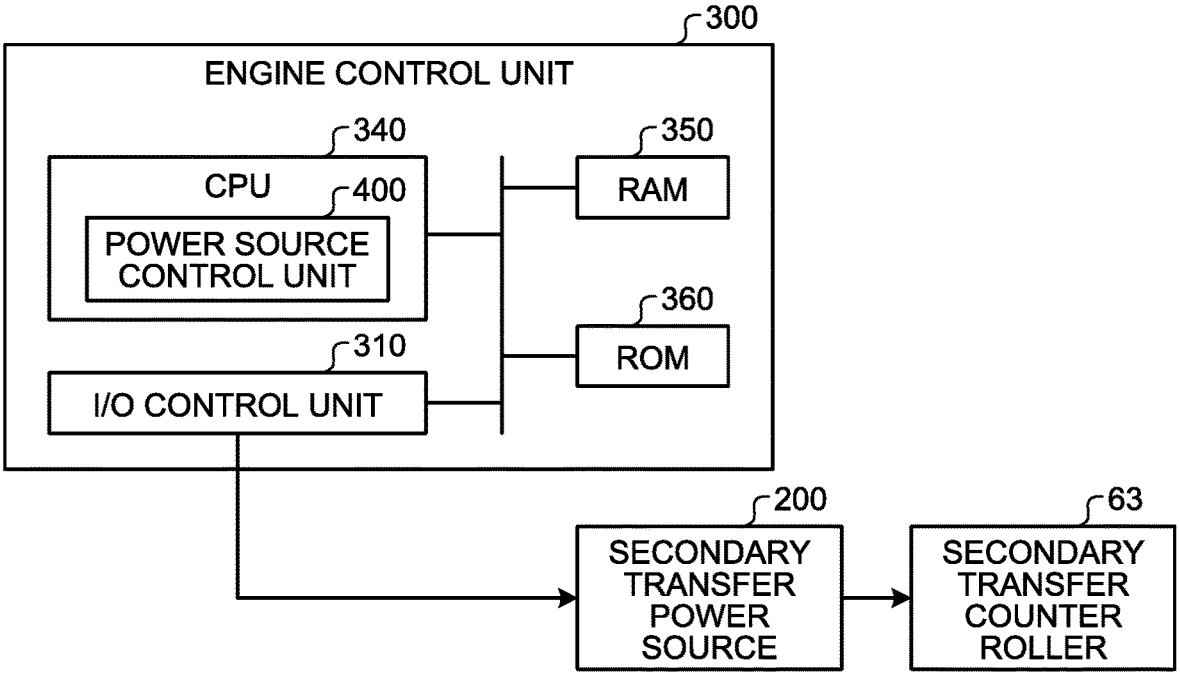
FIG. 5 is a block diagram illustrating an example of a configuration of an engine control unit included in the printing apparatus.

FIG. 5 is a block diagram illustrating an example of a configuration of an engine control unit 300 included in the printing apparatus 1. As illustrated in FIG. 5, the printing apparatus 1 includes an engine control unit 300, the secondary transfer power source 200, and the secondary transfer counter roller 63.

The engine control unit 300 performs engine control, for example, control related to image formation, and includes an I/O control unit 310, a random access memory (RAM) 350, a read only memory (ROM) 360, and a CPU 340.

The I/O control unit 310 controls input and output of various signals, and controls input and output of signals exchanged with the secondary transfer power source 200.

The RAM 350 is a volatile storage device (memory), and used as a work area for the CPU 340 or the like.

The ROM 360 (an example of a storage unit) is a nonvolatile storage device (memory) for reading, and stores therein various programs executed by the printing apparatus 1, data used in various types of processing executed in the printing apparatus 1, and the like. The ROM 360 may be realized by a flash memory or the like, and may be used for writing. For example, the ROM 360 stores therein specific information specifying a constant voltage switch timing where the direct current power source 210 is caused to perform switchover to constant voltage control, and a constant current switch timing where the direct current power source 210 is caused to perform switchover to constant current control (examples of the predetermined timing). The specific information specifies the constant voltage switch timing and constant current switch timing, based on, for example, a print start reference signal indicating a print start criterion.

The CPU 340 receives input of the print start reference signal, and receives a user setting from an operating unit (illustration thereof being omitted in the drawings), such as an operation panel. If, for example, the recording paper is ordinary paper, a user inputs, from the operating unit, "high voltage output with DC bias only" as the user setting for high voltage output, and if the recording paper is leather-textured paper high in surface roughness, the user inputs, from the operating unit, "high voltage output with superimposed bias" as the user setting for high voltage output. The CPU 340 then causes, via the I/O control unit 310, the secondary transfer power source 200 to perform high voltage output according to the user setting. The CPU 340 includes the power source control unit 400.

When the power source control unit 400 causes the secondary transfer power source 200 to perform high voltage output (direct current voltage output or superimposed voltage output), the power source control unit 400 controls, based on the specific information stored in the ROM 360, output of direct current voltage by the direct current power source 210. Specifically, the power source control unit 400 causes, based on the specific information, the direct current power source 210 to perform switchover to constant voltage control and constant current control.

Described hereinafter are characteristics of the printing apparatus 1 according to the embodiment.

Figure 6:
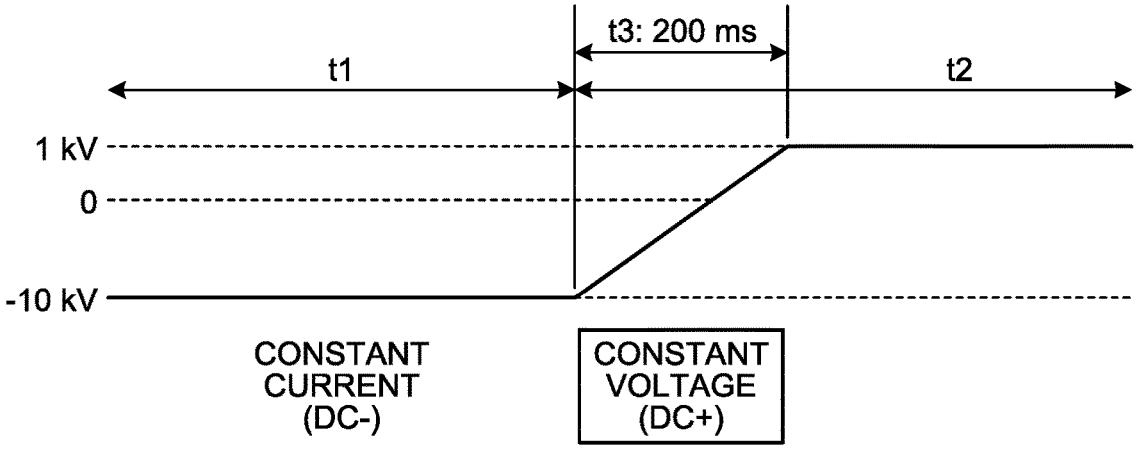
FIG. 6 is a diagram illustrating an example of how direct current output that is output to a load upon constant voltage control falls.

FIG. 6 is a diagram illustrating an example of how direct current output that is output to the load 500 upon constant voltage control falls. FIG. 6 illustrates how the direct current output falls from a reverse DC bias (−10 kV) at the end of secondary transfer, to a DC bias (1 kV). A bias herein refers to a voltage applied to the load 500 from the direct current power source 210. A reverse bias means that the bias is at a negative potential.

In a transfer period t1 illustrated in FIG. 6, transfer is performed at the reverse DC bias (−10 kV) by constant current (DC−) control, and in a rise period t3 for a non-transfer period t2, the direct current output is caused to reach the target DC bias (1 kV) by switchover to constant voltage (DC+) control. In this case, in a short time period, such as, for example, 200 ms, the target value is able to be reached.

Although illustration is omitted in the drawings, thereafter, when the next transfer period comes, by constant voltage (DC+) control, the direct current output is caused to reach the reverse DC bias (−10 kV) in a short time period. In the case of constant voltage control, the amount of charge output as a DC bias is theoretically infinite, and thus a charge is able to be accumulated in the alternating current bypass capacitor 326 in a short time period.

Next, specific control of the secondary transfer power source 200 will be described.

Figure 7:
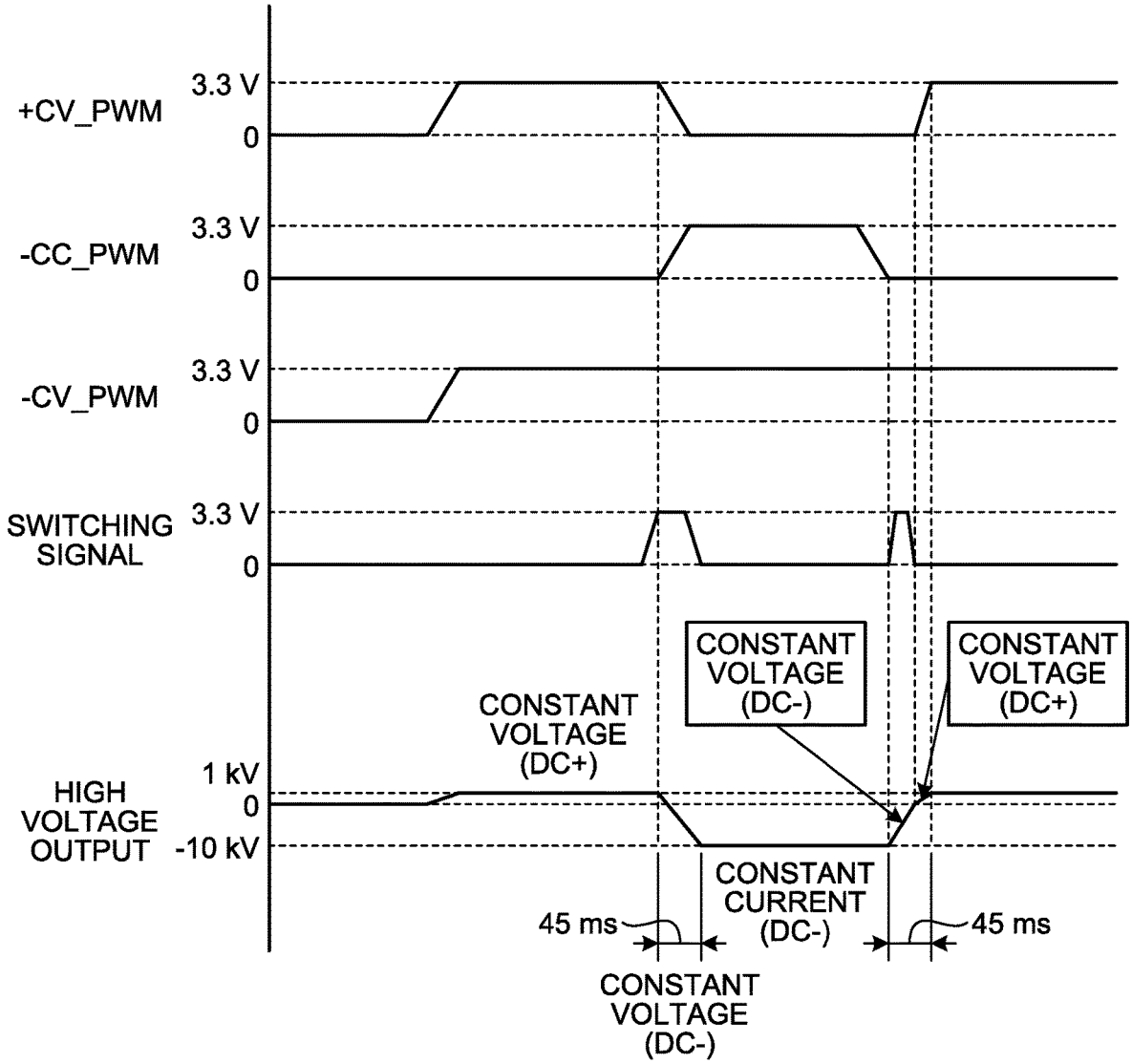
FIG. 7 is diagram illustrating a switching control sequence and a fall time.

FIG. 7 is a diagram illustrating a switching control sequence and a fall time. A fall in FIG. 7 will be noted.

When a constant voltage switch timing is reached, the power source control unit 400 outputs, to the direct current power source 210, a switching signal (a switching signal from Low to High) instructing switchover from constant current control (DC−) to constant voltage control (DC−). In response, when the direct current power source 210 receives the switching signal instructing the switchover to constant voltage control, the direct current power source 210 performs switchover from constant current control (DC−) to constant voltage control (DC−).

Subsequently, after the switchover from the constant current control (DC−) to the constant voltage control (DC−) by the direct current power source 210 has been completed and a predetermined time period has elapsed from the completion, the power source control unit 400 outputs the +CV_PWM signal. In response, the direct current power source 210 performs switchover from constant voltage control (DC−) to constant voltage control (DC+). The predetermined time period is variable.

As described already, when constant voltage control is performed, the alternating current bypass capacitor 326 is able to be discharged or charged in a short time period. However, for practical use, the amount of charge output as a DC bias is finite. Therefore, the mere ordinary constant voltage control (DC+) where the aimed DC bias value (1 kV) is achieved from the output of the reverse DC bias (−10 kV) takes much time.

However, by the switchover to constant voltage control (DC+) after constant voltage control (DC−), the fall time is able to be shortened more than that in the ordinary sequence. Described below are two reasons why execution of constant voltage control (DC+) after constant voltage control (DC−) enables the reduction of the fall time more than when only constant voltage control (DC+) is executed.

The first reason is the difference in power of the transformers.

A relevant fact is that the transformer (DC−) 334 that produces the reverse DC bias is able to flow an amount of current that is larger than that by the transformer (DC+) 335 that produces the DC bias. The transformer (DC+) 335 just needs to perform output of up to 1 kV for practical use, and is thus smaller in power in terms of size, cost, an the like suitable for the output.

The second reason is the difference in processing from the control signal to the driving.

According to the sequence illustrated in FIG. 7, the −CV_PWM signal is always in an ON-state except for the first rise. Therefore, constant voltage control (DC−) always lies in wait before the transmission of the control signal to the drive circuit. This is done for control to be taken away from constant current control (DC−) by input of a switching signal in this state. The +CV_PWM signal also requires the time for calculation of the integral of PWM, from the time the +CV_PWM signal is turned on until the output is started. However, that time for calculation of the integral is able to be shortened for the −CV_PWM signal.

Therefore, a fall time of 45 ms from the reverse DC bias of −10 kV to the DC bias of 1 kV is enabled.

The timing for the switchover from constant voltage control (DC−) to constant voltage control (DC+) may be set by a user. Or, when the capacity in the alternating current bypass capacitor 326 is detected from the alternating current voltage FB signal, the FB_V(AC−) signal, and it is detected that a charge equal to or greater than a predetermined capacity has been discharged from the alternating current bypass capacitor 326, switchover from constant voltage control (DC−) to constant voltage control (DC+) may be performed. By detection of the capacity inside the alternating current bypass capacitor 326 through the FB_V(AC−) signal, the life (state) of the alternating current bypass capacitor 326 may be predicted and a user may be notified of the life (state). Furthermore, the capacity inside the alternating current bypass capacitor 326 may be detected, and a user may be notified of optimum switch timings according to the type of paper and image.

Switchover from constant voltage control (DC−) to constant voltage control (DC+) has been described as an example, but switchover from constant voltage control (DC+) to constant voltage control (DC−) and then to constant voltage control (DC+) may be performed instead.

Described next is operation of the printing apparatus 1 according to the embodiment.

Figure 8:
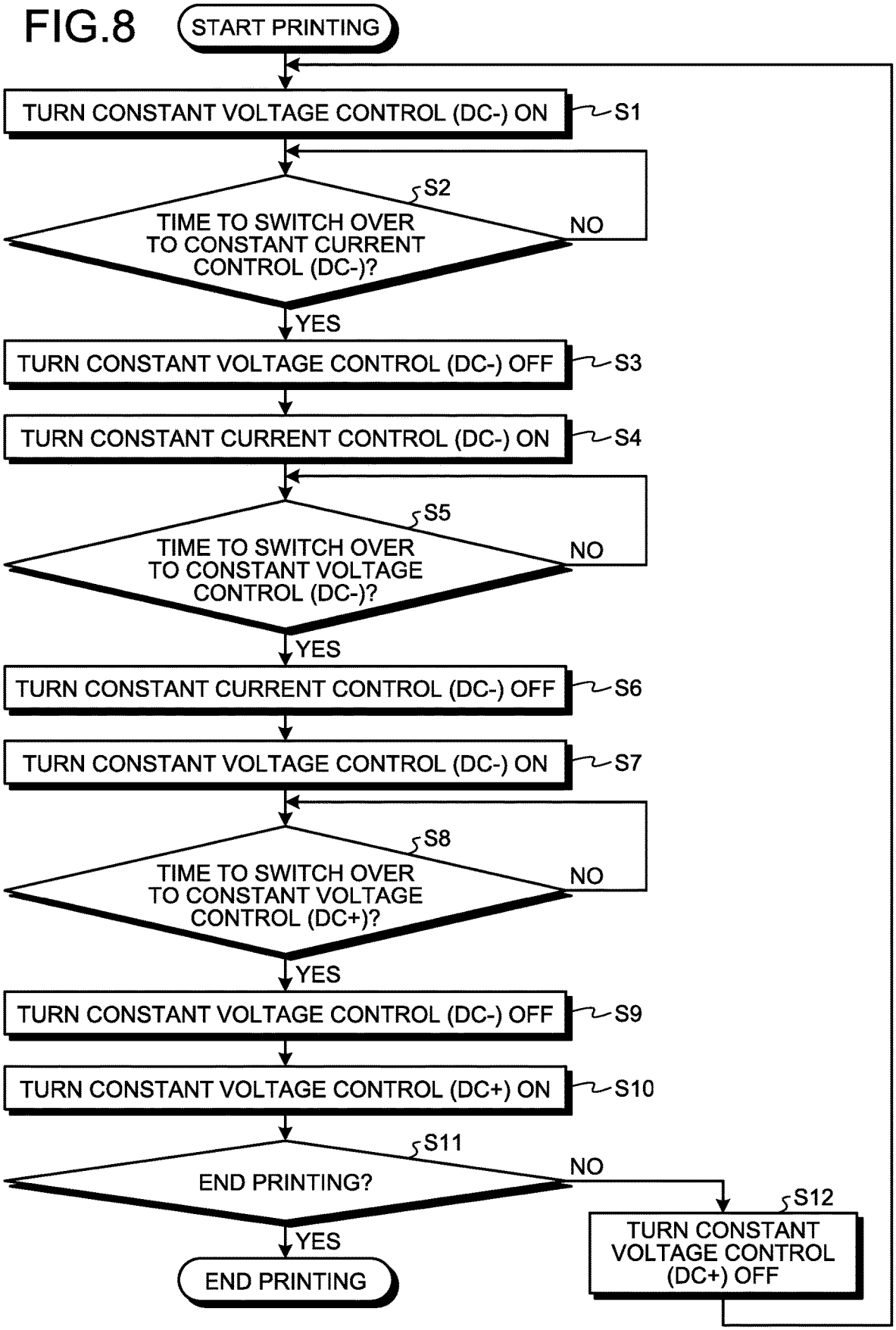
FIG. 8 is a flow chart illustrating an example of a flow of a printing process executed in a direct current power source and a power source control unit.

FIG. 8 is a flow chart illustrating an example of a flow of a printing process executed in the direct current power source 210 and the power source control unit 400.

As illustrated in FIG. 8, firstly, the power source control unit 400 inputs a signal for constant voltage control (DC−), to the direct current power source 210, and turns the constant voltage control (DC−) on (Step S1).

Subsequently, after predetermined operation, the power source control unit 400 waits for a switch timing for switchover to constant current control (DC−) (Step S2: No).

When the switch timing is reached (Step S2: Yes), the power source control unit 400 turns constant voltage control (DC−) off (Step S3), and switches constant current control (DC−) on (Step S4).

Thereafter, after predetermined operation, the power source control unit 400 waits for a switch timing for switchover to constant voltage control (DC−) (Step S5: No).

When the switch timing is reached (Step S5: Yes), the power source control unit 400 turns the constant current control (DC−) off (Step S6), and switches constant voltage control (DC−) on (Step S7).

Thereafter, after predetermined operation, the power source control unit 400 waits for a switch timing for switchover to constant voltage control (DC+) (Step S8: No).

When the switch timing is reached (Step S8: Yes), the power source control unit 400 turns the constant voltage control (DC−) off (Step S9), and switches constant voltage control (DC+) on (Step S10).

If printing is available next in the state where the constant voltage control (DC+) is on (Step S11: No), the power source control unit 400 turns the constant voltage control (DC+) off (Step S12), and returns to Step S1.

On the contrary, if printing is not available next in the state where the constant voltage control (DC+) is on (Step S11: Yes), the power source control unit 400 ends the printing process.

As described above, according to this embodiment, the direct current power source 210 has therein mechanisms for the constant voltage control and constant current control, the constant current control is performed on output of direct current voltage upon a fall of the direct current voltage, output is performed by switchover to the constant voltage control when a predetermined condition is satisfied, and thus the fall time is able to be shortened and reduction in image quality is able to be prevented, just by the control, without increase in cost of the power sources.

A program executed by the power source control unit 400 according to the embodiment is provided by being incorporated in a ROM or the like beforehand.

Furthermore, the program executed by the power source control unit 400 according to the embodiment may be stored on a computer connected to a network, such as the Internet, and provided by being downloaded via the network. Moreover, the program executed by the power source control unit 400 according to the embodiment may be provided or distributed via a network, such as the Internet.

Furthermore, the program executed by the power source control unit 400 according to the embodiment may be provided by being stored, as a file of an installable format or executable format, in a computer-readable storage medium, such as a CD-ROM, a CD-R, a memory card, a DVD, or a flexible disk (FD).

The program executed by the power source control unit 400 according to the embodiment has a module configuration for the power source control unit 400 to be implemented on a computer. As to actual hardware, for example, by a CPU loading and executing the program from a ROM onto a RAM, each of the above described units is implemented on a computer.

Achieved according to the present invention is an effect of enabling a rise time to be shortened and reduction in image quality to be prevented just by control, without increase in cost of power sources.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus, comprising:

a power source device, including:

a direct current power source that outputs a direct current voltage;

an alternating current power source that outputs a superimposed voltage having an alternating current voltage superimposed on the direct current voltage;

a bypass capacitor that partially accumulates a charge of alternating current for prevention of flow of current into the direct current power source from the alternating current power source; and a power source control unit that switches control of the direct current voltage from constant current control to constant voltage control and causes a charge of the alternating current to be accumulated in the bypass capacitor between an end of a transfer period and a beginning of non-transfer period, both related to image formation performed by the image forming apparatus, wherein the power source control unit outputs a switching signal instructing switchover from the constant current control to the constant voltage control, to the direct current power source, when a predetermined timing is reached, upon the constant current control, wherein the predetermined timing is a timing specified based on a print start reference signal.

2. The image forming apparatus according to claim 1, wherein the power source control unit controls output of the direct current voltage by the direct current power source upon the constant voltage control.

3. The image forming apparatus according to claim 1, wherein the power source control unit outputs a switching signal instructing switchover from the constant voltage control to the constant current control, to the direct current power source, when a predetermined timing is reached, upon the constant voltage control.

4. The image forming apparatus according to claim 3, wherein the predetermined timing is a timing specified based on a print start reference signal.

5. The image forming apparatus according to claim 1, wherein the power source control unit switches the constant voltage control from constant voltage control (DC−) to constant voltage control (DC+), based on a capacity of charge accumulated in the bypass capacitor, wherein DC− indicates that a voltage to ground of an output of the power source device is negative, and wherein DC+ indicates that the voltage to ground of the output of the power source device is positive.

6. The image forming apparatus according to claim 5, wherein the power source control unit has, for the direct current power source, a direct current control signal for constant current control where magnitude of output of a direct current voltage (DC−) is controlled, a direct current control signal for constant current control where magnitude of output of a direct current (DC−) is controlled, a direct current control signal for constant voltage control where magnitude of output of a direct current voltage (DC+) is controlled, and a switching signal instructing switchover among the constant voltage control (DC−), constant current control (DC−), and the constant voltage control (DC+).

7. The image forming apparatus according to claim 1, wherein the power source control unit notifies a user of a state of the bypass capacitor, based on a capacity of charge accumulated in the bypass capacitor.

8. A power source control method in a power source device of an image forming apparatus, the power source device comprising: a direct current power source that outputs a direct current voltage; an alternating current power source that outputs a superimposed voltage having an alternating current voltage superimposed on the direct current voltage; and a bypass capacitor that partially accumulates a charge of alternating current for prevention of flow of current into the direct current power source from the alternating current power source, the power source control method including:

switching control of the direct current voltage from constant current control to constant voltage control when a predetermined timing is reached based on a print start reference signal; and causing a charge of the alternating current to be accumulated in the bypass capacitor between an end of a transfer period and a beginning of non-transfer period, both related to image formation performed by the image forming apparatus.

9. An image forming apparatus, comprising:

a direct current power source that outputs a direct current voltage;

an alternating current power source that outputs a superimposed voltage having an alternating current voltage superimposed on the direct current voltage;

a bypass capacitor that partially accumulates a charge of alternating current for prevention of flow of current into the direct current power source from the alternating current power source; and a power source control unit that switches control of the direct current voltage from constant current control to constant voltage control when a predetermined timing is reached based on a print start reference signal, and causes a charge of the alternating current to be accumulated in the bypass capacitor between an end of a transfer period and a beginning of a non-transfer period, both related to image formation performed by the image forming apparatus.

* * * * *